US005164146A

United States Patent [19]

Jafs et al.

[11] Patent Number: 5,164,146

[45] Date of Patent: Nov. 17, 1992

[54] FOUNDRY FURNACE HAVING OUTLET FLOW PASSAGE

[75] Inventors: Daniel Jafs, Helsingfors, Finland; Jakob S. Jafs, Uplands-Vasby, Sweden

[73] Assignee: AB Jafs Export Oy Holimesy, Finland

[21] Appl. No.: 609,701

[22] Filed: Nov. 6, 1990

[51] Int. Cl.[5] ..... C22B 9/16

[52] U.S. Cl. ..... 266/227; 266/236; 266/901; 75/709

[58] Field of Search ..... 266/901, 227, 236; 75/709

[56] References Cited

U.S. PATENT DOCUMENTS

| | | | |
|---|---|---|---|
| 4,002,468 | 1/1977 | Stauffer | 266/901 |
| 4,432,791 | 2/1984 | Jayaraman et al. | 266/901 |
| 4,589,634 | 5/1986 | Bleickert et al. | 266/215 |

FOREIGN PATENT DOCUMENTS

| | | |
|---|---|---|
| 0200671 | 12/1986 | European Pat. Off. . |
| 1539412 | 1/1979 | United Kingdom . |

*Primary Examiner*—Melvyn J. Andrews

*Attorney, Agent, or Firm*—Willian Brinks Olds Hofer Gilson & Lione

[57] ABSTRACT

Foundry furnace particularly for light non-ferrous metal, such as zinc or aluminum, including a longitudinal chamber (4, 8, 11, 12) made of a heat-resistant material, including close to one end an inlet for scrap (18) and/or bars (5), a slag outlet (5,6), an outlet flow passage (13) including a dispensing opening (14) at the other end, and heating elements for melting the metal, including direct radiating resistance elements (3, 3') in the cover of the chamber (4, 12) and vertically free moving dip-elements (9) extending downwardly from the cover of the chamber (8) for flowing on and into the melt metal in the chamber (8). According to the invention the height of the outlet flow passage is around $\frac{1}{3}$-$\frac{2}{3}$ of the height of the chamber (8, 12), and the active part (7) of the dip-elements in the vertical direction at most equals the distance of the bottom (16) of the outlet flow passage (13) from the bottom (17) of the chamber. The foundry furnace can be operated although there are big variations in the feeding in and out, and the feeding out can be totally stopped, for instance for exchanging a valve (24) in the dispensing opening (14) without the need for emptying the foundry furnace from melt.

9 Claims, 2 Drawing Sheets

FOUNDRY FURNACE HAVING OUTLET FLOW PASSAGE

BACKGROUND OF THE INVENTION

This invention relates to a foundry furnace and particularly to a foundry furnace for light nonferrous metal, comprising a longitudinal chamber made of a heat-resistant material, including close to one end an inlet for the material to be melt, such as scrap and/or bars, a slag outlet at least at one end, an outlet flow passage including a dispensing opening at the other end, and heating elements for melting the metal, including direct radiating resistance elements in the cover of the chamber and vertically free moving dip-elements extending downwardly from the cover of the chamber for flowing on and into the melt metal.

In foundry furnaces of the above mentioned type the dosage opening for feeding out the melt metal has been placed in the bottom of the melting chamber or in a shallow flow passage close to the cover. Both of these solutions have disadvantages.

A leakage in the dispensing opening situated in the bottom of the foundry furnace requires the furnace to be shut down, i.e. it must be emptied and the leakage must be repaired. This causes a considerable operation break down and the heating element in the melt is destroyed and must be replaced. It would thus be an advantage if the furnace could be shut down for repairing an eventual leakage without emptying the furnace from its melt.

In a foundry furnace in which the dispensing opening for the melt is situated in a shallow flow passage close to the cover of the melt chamber e.g. the valve of the dosage opening can be replaced without emptying the chamber from melt. This solution has anyhow the disadvantage that the melt chamber can not be used as a buffer space. Feeding in scrap and bars and feeding out melt varies and it would thus be beneficial if the melt chamber could buffer these variations and differences between feeding in and out.

SUMMARY OF THE INVENTION

The purpose of the invention is to provide a foundry furnace, especially for light or nonferrous metal, as zinc and aluminum, which periodically can be shut down for repair without the need to totally empty the melt space, thus providing an effective use of the melt space as a buffer for compensating variations in feeding in and out.

The purpose of the invention is also to provide a foundry furnace, with a more simple and compact structure than before. The compact structure makes it also possible to lower the foundry costs and the working conditions in the foundry are also improved.

In light metal foundries there will be metal losses due to different reasons. If the metal content in scrap and slag can be recovered without large investment costs and without quality problems, the economy of the foundry will be improved. In known foundry furnaces the recovery has been complicated and thus expensive. The purpose of the present invention is thus to eliminate these disadvantages.

The purpose of the present invention is thus to achieve a foundry furnace especially for light metal, such as zinc and aluminum, which makes it possible to prewarm metalscrap, melt metal bars and recover metal and slag through remelting, and furthermore to clean and dispense the melt metal to the cast site in a foundry through only one furnace.

Variations in the feeding in and feeding out are buffered effectively by using a groove, the height of which is around $\frac{1}{3}$–$\frac{2}{3}$ of the height of the chamber, whereas the active part of the dip-element in the vertical direction at most equals the distance of the bottom of the outlet flow passage from the bottom of the chamber so that the active part of the dip-element remains immersed in the melt even when the foundry furnace is totally shut down i.e. for repairment.

So as to enable control of the melt's temperature and its composition longitudinally in the foundry furnace, the bottom of the chamber in a preferred embodiment of the invention has upwardly directed threshold walls between the dip-elements and the outlet flow passage, i.e. between the outlet chamber and the melt chamber, so that the vertical dimension of the threshold wall is smaller than the distance between the bottom of the outlet flow passage and the bottom of the chamber so that melt can be transported from the melt chamber to the dosage chamber even when the melt level is at its lowest level.

In order to partition the longitudinal direction of the chamber in different zones, the chamber might have longitudinally at a distance from each other downwardly from the cover, situated partition walls between the inlet and the dip-elements, i.e. between charging chamber and the melt chamber, which partition walls extend to a level which is lower than the bottom of the outlet flow passage and preferably to the same level as the upper edge of the threshold wall. In the cover between the two downwardly projecting partition walls separate direct radiating resistance elements can be placed so as to keep the temperature high enough in the melt which is situated in this slag recovering chamber.

In this slag recovering chamber slag can be feeded so as to recover the metal content of it, e.g. by a longitudinal upwardly open slag box with holes in its bottom and which is made of heat-resistant material which is kept floating on the surface of the melt and which is let in and out through a door in the side wall in the slag recovery chamber between the mentioned downwardly projecting partition walls.

The dispensing opening, which preferably is projecting downwardly from the bottom of the outlet flow passage, has in a preferred embodiment one also vertically situated mandrel which has a cone at its lower end, which closely is connected to a corresponding conical, downwardly tapering opening in the upper inlet end of the dispensing opening. With such a valve a good closing is achieved of the dosage dispensing opening.

BRIEF DESCRIPTION OF THE DRAWINGS

The present invention will be further described in detail with reference to the accompanying drawings, in which.

DETAILED DESCRIPTION OF THE PRESENTLY PREFERRED EMBODIMENTS OF THE INVENTION

Figure 1:
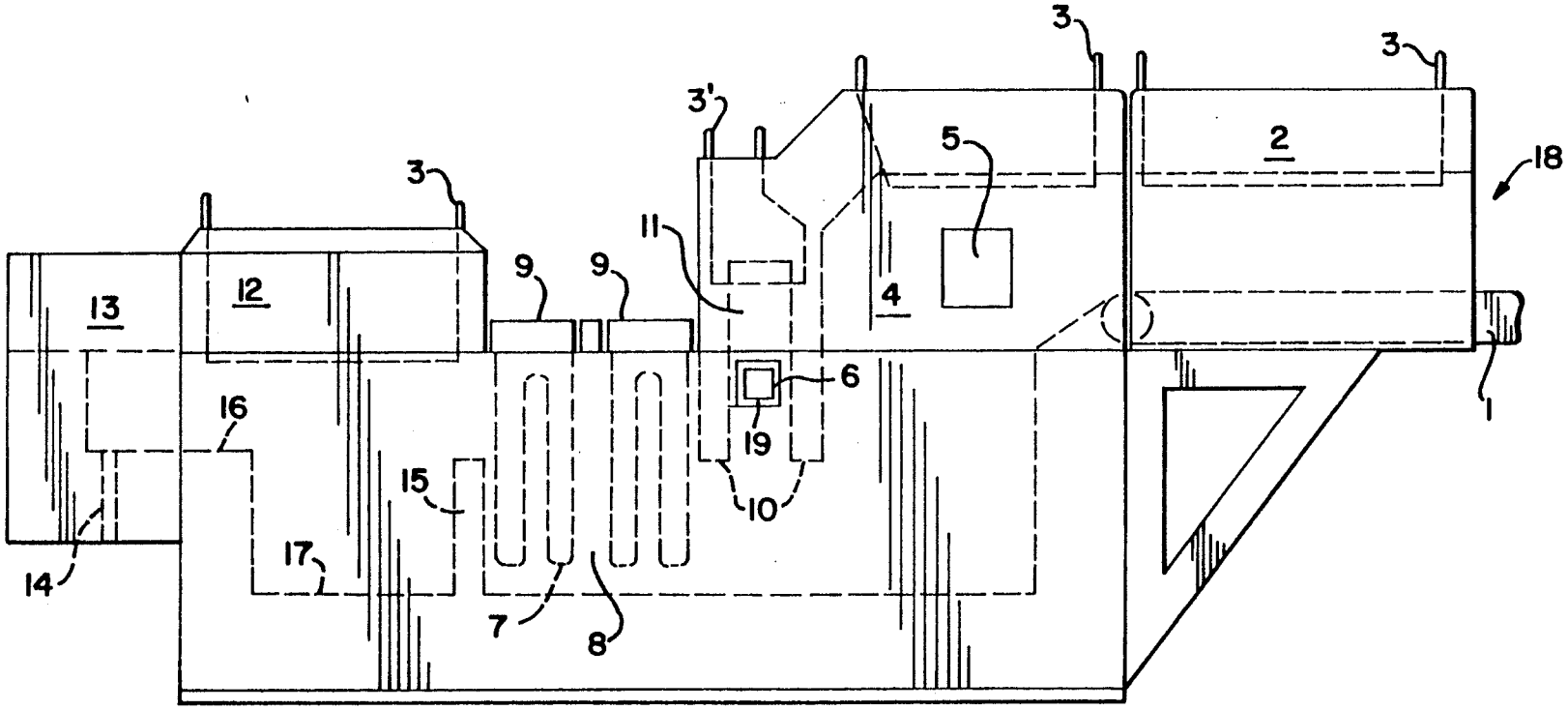
FIG. 1 illustrates a side view of a preferred embodiment of the invention.
Figure 2:
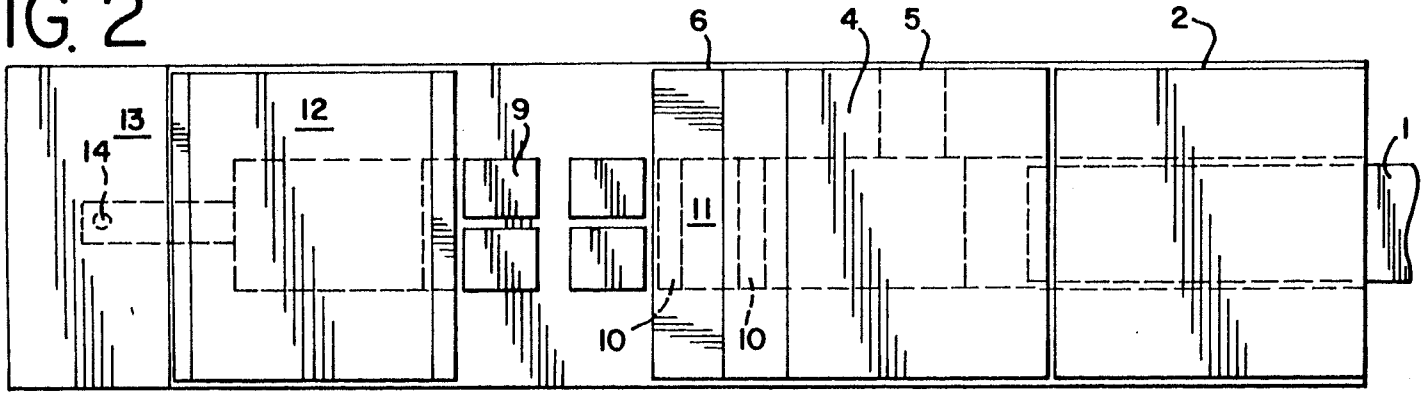
FIG. 2 shows the same embodiment from above and FIG. 3 is a more detailed view of the opening and valve employed in a preferred embodiment of the invention.
Figure 3:
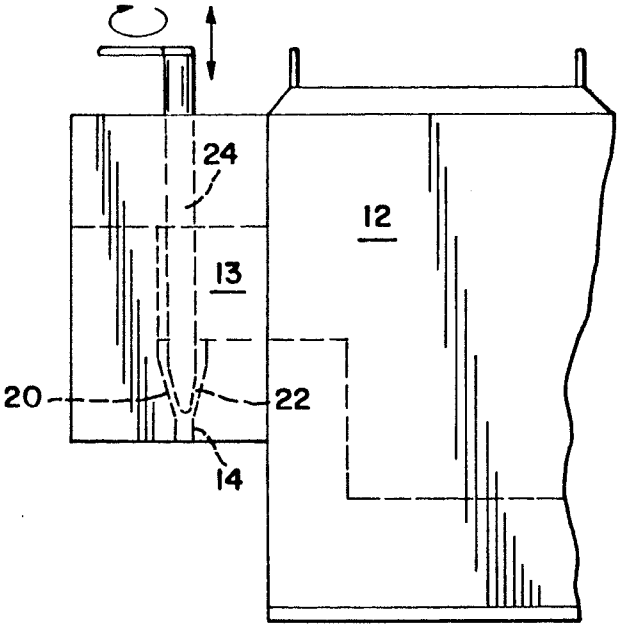

The foundry furnace shown in the drawings has a longitudinal chamber made of heat-resistant material, which has been divided in different sections, that is a) a preheating chamber with an inlet 18, a conveyor 1 and a heating cover with integral controllable, electrical, direct radiating resistance elements 3' for feeding in and preheating (drying) scrap, b) a charging chamber 4, c) a melt chamber 8, and d) a an outlet chamber 12 with a dispensing outlet 10 under 13 and or flow passage opening 14, which possibly has an outlet valve 18. Between the charging chamber 4 and the melt chamber 8 there is also e) a lag recovery chamber 11, in which a higher temperature can be maintained by means of the heating element which is built-in in its cover.

The charging chamber 4 and the outlet chamber 12 have also a heating cover which has direct radiating resistance elements 3 of the above mentioned type. The melt chamber 8 provides on the other hand at its upper regions isolated heating through dip-elements 9, which float on the surface of the melt, which elements have downwardly projecting electrical resistance elements 7 which immersed in the melt, so that these are vertically moving as a result of level changings in the melt. The dip-elements 9 might also have thermo elements (not illustrated) for measuring the temperature of the melt.

The charging chamber has a door 5 for feeding metal bars and for removing slag from the surface of the melt in the charging chamber 4. The door 5 is thus situated above the surface of the melt, about at the same level as the conveyor 1. The slag recovery chamber 11 is separated form the charging chamber 4 and the melt chamber 8 by two longitudinally, at a distance from each other situated partition walls 10, which project downwardly to about the same level as the bottom 16 of the outlet flow passage 13. Between the partition walls 10 is a door 6 situated for putting in and taking out a slag box-19, which has an upwardly open longitudinal box with a perforated bottom. In the slag recovery chamber 11 a higher temperature than in other parts of the foundry furnace can be maintained by means of the resistance elements 3' so that the light metal in the slag melts and flows through the perforation in the bottom of the slag box 19, after which the slag can be removed and dumped. The slag box 19 is made of a heat-resistant material which floats on the surface of the melt.

The melt chamber 8 and the outlet chamber 12 are separated from each other with a threshold wall 15 which projects upwardly from the bottom 17 of the foundry furnace, which wall projects upwardly to a level to some extent lower than the bottom 16 of the outlet flow passage 13.

The outlet flow passage 13 is relatively narrow, at the most a third of the width of the chamber and also relatively deep so that the bottom 16 of the flow passage is about half way between the heating cover and the bottom 17 of the outlet chamber. Such a shape of the outlet flow passage 13 makes it possible to take out melt from the foundry furnace through the dosage dispensing opening 14 despite great variations of the melt level, but in such a way, that feeding out melt can be interrupted for instance to exchange a vale in the dispensing opening 14 without the need for totally emptying the furnace from melt and so that the heating element 7 of the dip-elements 9 is not destroyed.

The vertically downwardly projecting dispensing opening 14 can preferably be closed with an also vertical, downwardly from the bottom of the flow passage projecting mandrel 24, which has a cone 22 at its lower end, which closely can be connected to a corresponding conical, downwardly tapering upper inlet end 20 of the dispensing opening 14. Dispensing of melt through the dispensing opening 14 can also be controlled by controlling the surface level of the melt in the foundry furnace and especially in the outlet chamber 12, for instance with a pump in the outlet chamber 12. Thus the outlet flow passage 3 will however be formed preferably longer than what is shown in the accompanying drawing.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

We claim:

1. A foundry furnace for light metals comprising:

a longitudinal chamber having a first end and a second end, said longitudinal chamber defining a height and having a top and a bottom;

an inlet for scrap disposed at said first end of the longitudinal chamber;

a slag outlet disposed between said first end and said second end of the longitudinal chamber;

a cover disposed at the top of said longitudinal chamber, said cover having at least one direct radiating resistance element;

at least one dip-element for floating inside said longitudinal chamber, said at least one dip-element being vertically free-moving with respect to the bottom of said longitudinal chamber and extending downwardly inside the longitudinal chamber, said at least one dip-element having a heating element and defining an active heating region; and an outlet flow passage having a bottom, said outlet flow passage disposed at said second end of the longitudinal chamber and situated at a level between $\frac{1}{3}$ and $\frac{1}{2}$ the height from the bottom of the longitudinal chamber, wherein said active heating region of the at least one dip-element extends in use at most from said bottom of said outlet flow passage to the bottom of said longitudinal chamber.

2. The foundry furnace defined in claim 1, further comprising a threshold wall disposed along said bottom of the longitudinal chamber between said first end of the longitudinal chamber and said outlet flow passage, the threshold wall defining a second height less than the height from the bottom if said outlet flow passage to the bottom of said longitudinal chamber.

3. The foundry furnace defined in claim 2, further comprising first and second partition walls disposed in the longitudinal chamber between said inlet and said threshold wall, each of said first and second partition walls projecting downwardly from said cover a distance parallel to the height of said threshold wall.

4. The foundry furnace defined in claim 3, further comprising a slag recovery chamber defined between said first and second partition walls, the slag recovery chamber having a door for insertion and removal of a slag box.

5. The foundry furnace defined in claim 4, wherein the slag box comprises a bottom including a plurality of perforations, said slag box being made of a heat-resistant material.

6. The foundry furnace defined in claim 3, further comprising a direct radiating heating element disposed in said cover of the longitudinal chamber between said first and second partition walls.

7. The foundry furnace defined in claim 1, wherein said outlet flow passage includes a distal end, said outlet flow passage further comprising a downwardly projecting dispensing opening disposed at said distal end.

8. The foundry furnace defined in claim 7, wherein said downwardly projecting dispensing opening comprises a conical downwardly tapering section.

9. The foundry furnace defined in claim 8, further comprising a downwardly projecting coaxial mandrel, said coaxial mandrel defining a lower end and including a conical section at said lower and to cooperate with the conical downwardly tapering section of said dispensing opening to selectively operatively open and close said dispensing opening.

* * * * *

UNITED STATES PATENT AND TRADEMARK OFFICE

CERTIFICATE OF CORRECTION

PATENT NO. : 5,164,146
DATED : November 17, 1992
INVENTOR(S) : Daniel Jafs et al.

It is certified that error appears in the above-indentified patent and that said Letters Patent is hereby corrected as shown below:

IN THE ABSTRACT: Item [57]

On the title page, line 1 of the Abstract, after "light", insert --or--.

In column 1, line 19, delete "dosage" and substitute therefor --dispensing--.

In column 2, line 4, delete "a groove" and substitute therefor --an outlet flow passage--.

In column 2, line 60, before "and", insert --;--.

In column 3, line 4, delete "3′" and substitute therefor --3--.

UNITED STATES PATENT AND TRADEMARK OFFICE

CERTIFICATE OF CORRECTION

PATENT NO. 5,164,146
DATED November 17, 1992
INVENTOR(S) : Daniel Jafs et al.

It is certified that error appears in the above-indentified patent and that said Letters Patent is hereby corrected as shown below:

In column 3, line 7, delete "10 under 13 and" and substiture therefor --launder--.

In column 3, line 7, after "passage", insert --13 and a dispensing--.

In column 3, line 10, delete "lag" and substitute therefor --slag--.

In column 3, line 12, before "which", insert --3'--.

In column 3, line 20, before "immersed", insert --are--.

In column 3, line 29, delete "form" and substitute therefor --from--.

In column 3, line 52, delete "flow".

In column 3, line 59, delete "vale" and substitute therefor --valve--.

In column 3, line 62, delete "elements" and substitute therefor --element--.

In column 4, line 5, after "12", insert --.--.

In column 4, line 6, delete "3" and substitute therefor --13--.

UNITED STATES PATENT AND TRADEMARK OFFICE

CERTIFICATE OF CORRECTION

PATENT NO. : 5,164,146

DATED : November 17, 1992

INVENTOR(S) : Daniel Jafs et al.

It is certified that error appears in the above-indentified patent and that said Letters Patent is hereby corrected as shown below:

Column 4:

In claim 1, line 38, delete "1/2" and substitute therefor --2/3--.

Column 4:

In claim 2, line 48, delete "if" and substitute therefor --of--.

Column 6:

In claim 9, line 4, delete "and" and substitute therefor --end--.

Signed and Sealed this

Twenty-second Day of November, 1994

Attest:

Bruce Lehman

BRUCE LEHMAN

Attesting Officer

Commissioner of Patents and Trademarks